US007966784B2

(12) United States Patent
Wobber

(10) Patent No.: US 7,966,784 B2
(45) Date of Patent: Jun. 28, 2011

(54) VENEER ANCHORING SYSTEM

(75) Inventor: Stephen F. Wobber, Camas, WA (US)

(73) Assignee: The ECI Group, LLC, Vancouver, WA (US)

( * ) Notice: Subject to any disclaimer, the term of this patent is extended or adjusted under 35 U.S.C. 154(b) by 0 days.

(21) Appl. No.: 12/366,577

(22) Filed: Feb. 5, 2009

(65) Prior Publication Data

US 2009/0133351 A1 May 28, 2009

Related U.S. Application Data

(63) Continuation of application No. 11/233,238, filed on Sep. 21, 2005, now abandoned.

(51) Int. Cl.
*E04B 1/38* (2006.01)

(52) U.S. Cl. ..... 52/513; 52/713; 52/410

(58) Field of Classification Search ..... 52/379, 52/410, 513, 712–714
See application file for complete search history.

(56) References Cited

U.S. PATENT DOCUMENTS

| | | | |
|---|---|---|---|
| 1,871,809 | A | 8/1932 | Lampert |
| 2,338,328 | A | 1/1944 | Handel |
| 3,259,148 | A | 7/1966 | Krengel |
| 4,021,990 | A | 5/1977 | Schwalberg |
| 4,598,518 | A | 7/1986 | Hohmann |
| 4,622,796 | A | 11/1986 | Aziz |
| 4,738,070 | A | 4/1988 | Abbott |
| 4,885,884 | A | 12/1989 | Schilger |
| 4,955,172 | A | 9/1990 | Pierson |
| 5,035,099 | A | 7/1991 | Lapish |
| 5,454,200 | A | 10/1995 | Hohmann |
| 5,634,310 | A | 6/1997 | Hohmann |
| 5,816,008 | A | 10/1998 | Hohmann |
| 6,279,283 | B1 | 8/2001 | Hohmann |
| 6,851,239 | B1 | 2/2005 | Hohmann |
| 6,925,768 | B2 | 8/2005 | Hohmann |
| 6,994,485 | B2 | 2/2006 | Konig |
| 2003/0127787 | A1 | 7/2003 | Konig |

OTHER PUBLICATIONS

"Anchoring for Glazing, Precast, Masonry, Stonework Services," Brochure 03150/HAL, Buyline 8419, Halfen Anchoring Systems, Converse, Texas, 1999, pp. 1-8.

Dur-O-Wal, Brochure 04082/DUR, Buyline 4961, Dur-O-Wal, Inc., Aurora, Illinois, 2000, pp. 1-16.

"We Anchor the World," Brochure 04082/HOH, Buyline 1823, Hohmann & Barnard, Inc., Hauppauge, New York, 2002, pp. 1-24.

*Primary Examiner* — Jeanette E Chapman
*Assistant Examiner* — Daniel Kenny
(74) *Attorney, Agent, or Firm* — Christensen O'Connor Johnson Kindness PLLC

(57) ABSTRACT

A masonry anchoring system for use in commercial and residential construction is described. In one aspect, the invention includes a brick tie that interfaces the masonry veneer and interlocks with an anchor plate mounted on a structure.

10 Claims, 9 Drawing Sheets

VENEER ANCHORING SYSTEM

CROSS-REFERENCE TO RELATED APPLICATION

This application is a continuation of U.S. application Ser. No. 11/233,238 filed on Sep. 21, 2005, the disclosure of which is hereby expressly incorporated by reference.

FIELD OF THE INVENTION

This invention relates generally to an anchoring system that couples masonry exterior to a structure, and more particularly, to an improved brick tie for coupling an outer veneer to an inner structure.

BACKGROUND OF THE INVENTION

The use of masonry veneer on a timber frame, steel frame, concrete masonry units ("CMU"), or concrete building is popular in building design because it is cost effective and provides an aesthetically pleasing appearance. Masonry veneer provides a number of significant benefits, acting as a rain screen, a thermal barrier, and a sound barrier. Many masonry veneers do not have the necessary structural integrity to accommodate the loads that can be imposed on them, such as wind and seismic forces. Therefore, the masonry veneer must be "tied" back to a structural backup wall that will carry the imposed loads. The masonry veneer must be continuously supported at regular vertical and horizontal intervals with masonry anchors because without continuous support, the masonry veneer may become overstressed, leading to vertical cracking and possible fracture. For commercial construction, code requirements mandate the use of a minimum gauge of steel for masonry anchors, a minimum spacing between masonry anchors, and the use of hot dip galvanized steel in manufacturing masonry anchors to prevent corrosion.

The use of a continuous wire in masonry veneer walls has been found to provide protection against problems arising from thermal expansion and contraction. Continuous wire also improves the uniformity of the distribution of lateral forces in a structure, thereby providing earthquake protection. The failure of several high-rise buildings to withstand wind and other lateral forces has resulted in the incorporation of a requirement for continuous wire reinforcement in the Uniform Building Code provisions.

Therefore, there is a need for a better system that couples a masonry veneer to a structure and inhibits undesired environmental intrusion, while avoiding or reducing the foregoing and other problems associated with existing masonry anchoring systems.

SUMMARY OF THE INVENTION

In accordance with this invention, a system, device, and method for anchoring a masonry veneer to a structure is provided. The device form of the invention includes, in a system for anchoring a masonry veneer to a structure, a brick tie that interfaces the masonry veneer and interlocks with an anchor plate mounted on a structure. The brick tie has a body with a substantially triangular shape that includes a base portion capable of interlocking with the anchor plate. A first side leg portion and a second side leg portion each extend from the base portion at diverging obtuse angles. A first front leg portion extends from the first side portion and a second front leg portion extends from the second side leg portion at converging acute angles. The first front leg portion and the second front leg portion are substantially parallel to one another. In some embodiments, the front leg portions partially overlap one another. In some embodiments, the two front leg portions are spaced apart from one another by a distance sufficient to allow the second leg portion to be inserted into the anchor plate.

In accordance with further aspects of the invention, a system form of the invention includes a masonry anchoring system. The masonry anchoring system includes at least one anchor plate mounted on a structure for anchoring a masonry veneer to the structure. Each anchor plate includes a body having a backing member and a projecting member that define a slot therebetween adapted to receive and interlock with a brick tie. The backing member includes means for attaching the anchor plate to the structure. The masonry anchoring system further includes at least one brick tie. Each brick tie interfaces the masonry veneer and interlocks with the anchor plate mounted on the structure. Each brick tie has a body with a substantially triangular shape that includes a base portion capable of interlocking with the anchor plate. A first side leg portion and a second side leg portion each extend from the base portion at diverging obtuse angles. A first front leg portion extends from the first side portion and a second front leg portion extends from the second side leg portion at converging acute angles. The first front leg portion and the second front leg portion are substantially parallel to one another.

In accordance with this invention, a method form of the invention includes a method for manufacturing a brick tie for use in a masonry anchoring system. The method includes fabricating a steel wire of appropriate gauge and dimension by bending the wire into a truncated triangular shape. The method includes stamping a portion of the front leg portions of the brick tie to form regions of deflection. In some embodiments, the method includes dipping the shaped wire form into a molten substance to form an alloy coating so as to provide cathodic protection.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Generally described, the present invention provides a system and device for anchoring masonry veneer to a structure, such as, for example, an interior wall or exterior wall of a building (commercial or residential). Masonry veneers are a popular construction design for commercial buildings. Various embodiments of the present invention provide a coupling system to securely anchor a masonry veneer to structural walls that complies with commercial building codes. Preferably, the coupling system eases the toilsome effort with which a mason installs masonry veneers. In various embodiments, a number of anchor plates which extend longitudinally are mounted on a wall of a structure. A corresponding number of brick ties interface the masonry veneer and each interlock with an anchor plate mounted on the wall of the structure.

The shape of the brick tie and the regions of deflection on the front legs of the brick tie provide several unexpected advantages over other brick ties used in anchoring systems. For example, the substantially triangular shape provides increased strength and lateral stability in comparison to a right angled shape. The triangular configuration allows for a secure positive engagement with the anchor plate and limits horizontal motion while still allowing for vertical flexibility. The front leg portions provide a wide surface area for improved mortar capture in the mortar joint. The triangular shape combined with the regions of deflection also provides ease of insertion for the bricklayer. For example, in one embodiment, the regions of deflection on the front legs of the brick tie allow a mason to easily clip the brick tie into the anchor plate. The overlapping front legs provide a region of positive engagement with the reinforcement wire, thereby providing additional strength to the anchoring system. Another unexpected advantage is the ease of manufacturing the brick tie from a single wire, as further described below.

Figure 1:
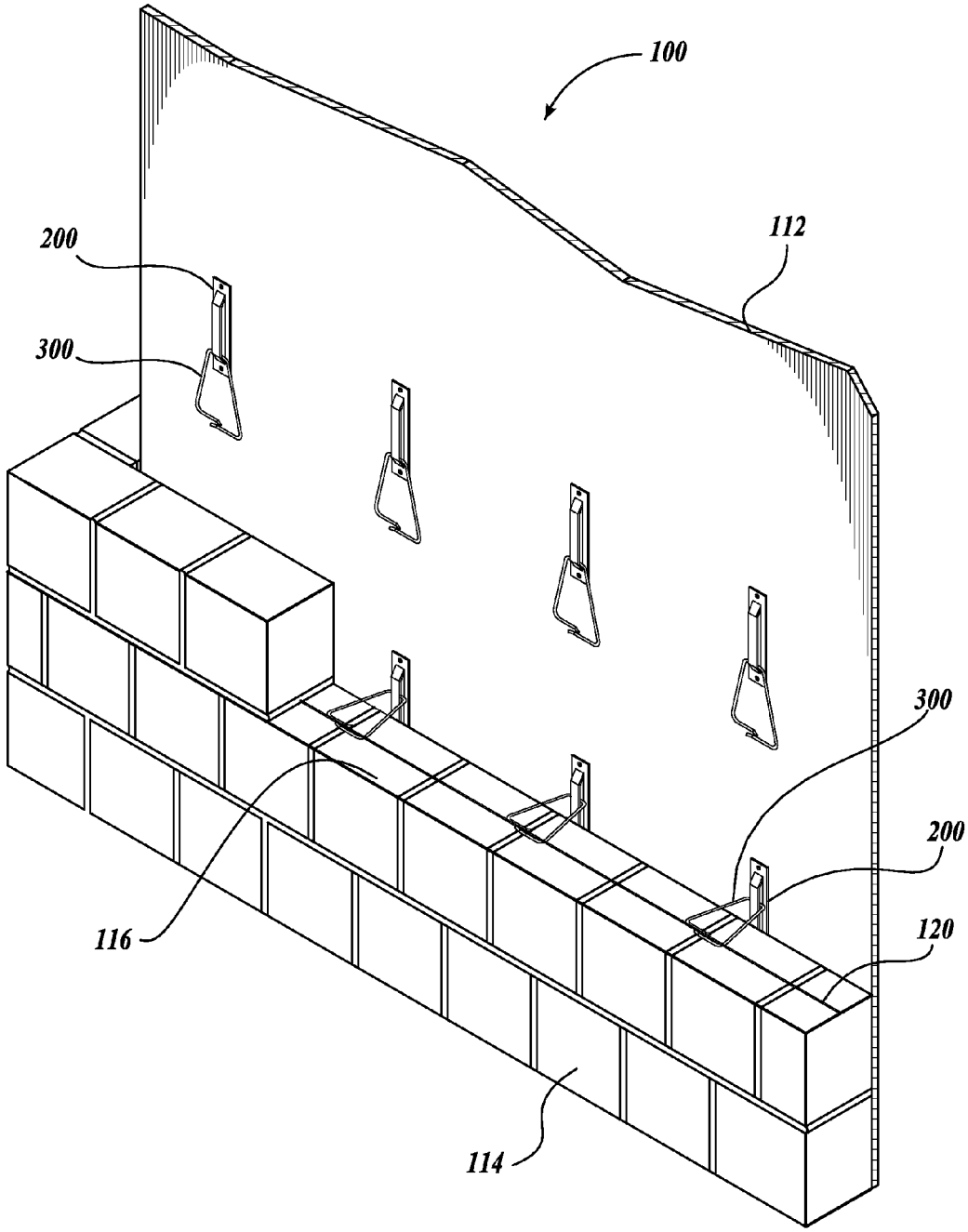
FIG. 1 is a perspective view of a portion of a building, illustrating an exemplary anchoring system for coupling a portion of brick veneer to a structure, the anchor system comprising anchor plates mounted to a structure having brick ties interlocked therein in accordance with an embodiment of the present invention.

FIG. 1 illustrates an exemplary masonry anchoring system 100. Briefly described, the masonry anchoring system 100 includes at least one anchor plate 200 mounted on a structure 112 and at least one brick tie 300 that interfaces a section of a masonry veneer 114 and interlocks with the anchor plate 200 to couple the masonry veneer 114 to the structure 112. The brick tie 300 is placed in a bed joint 116 of the masonry veneer 114. Reinforcing wire 120 runs through a wire capture element on the brick tie 300 and is embedded in mortar.

The masonry anchoring system 100 and devices are suitable for coupling masonry veneers to a structure in commercial and residential applications, allow for efficient installation and flexibility during construction, and are resistant to tension and compression forces. The masonry anchoring system 100 and devices of various embodiments of the present invention may be used in the construction of any building (for example, concrete, CMU, wood frame and steel frame buildings), whose exterior is covered by a masonry veneer. Accordingly, the system and devices of various embodiments of the present invention may be used by anyone involved in the construction of a building, such as construction workers, contractors, masons, bricklayers, masonry contractors and laypersons. Various embodiments of the present invention are particularly beneficial to masonry contractors, allowing for efficient installation of an anchoring system in order to maximize time available for laying brick. As described in more detail below, the anchor plate and brick tie design allow for increased strength and speed in the manufacture and installation process. The system may be fabricated out of heavy gauge steel and may be hot dip galvanized to comply with commercial building codes.

Figure 2:
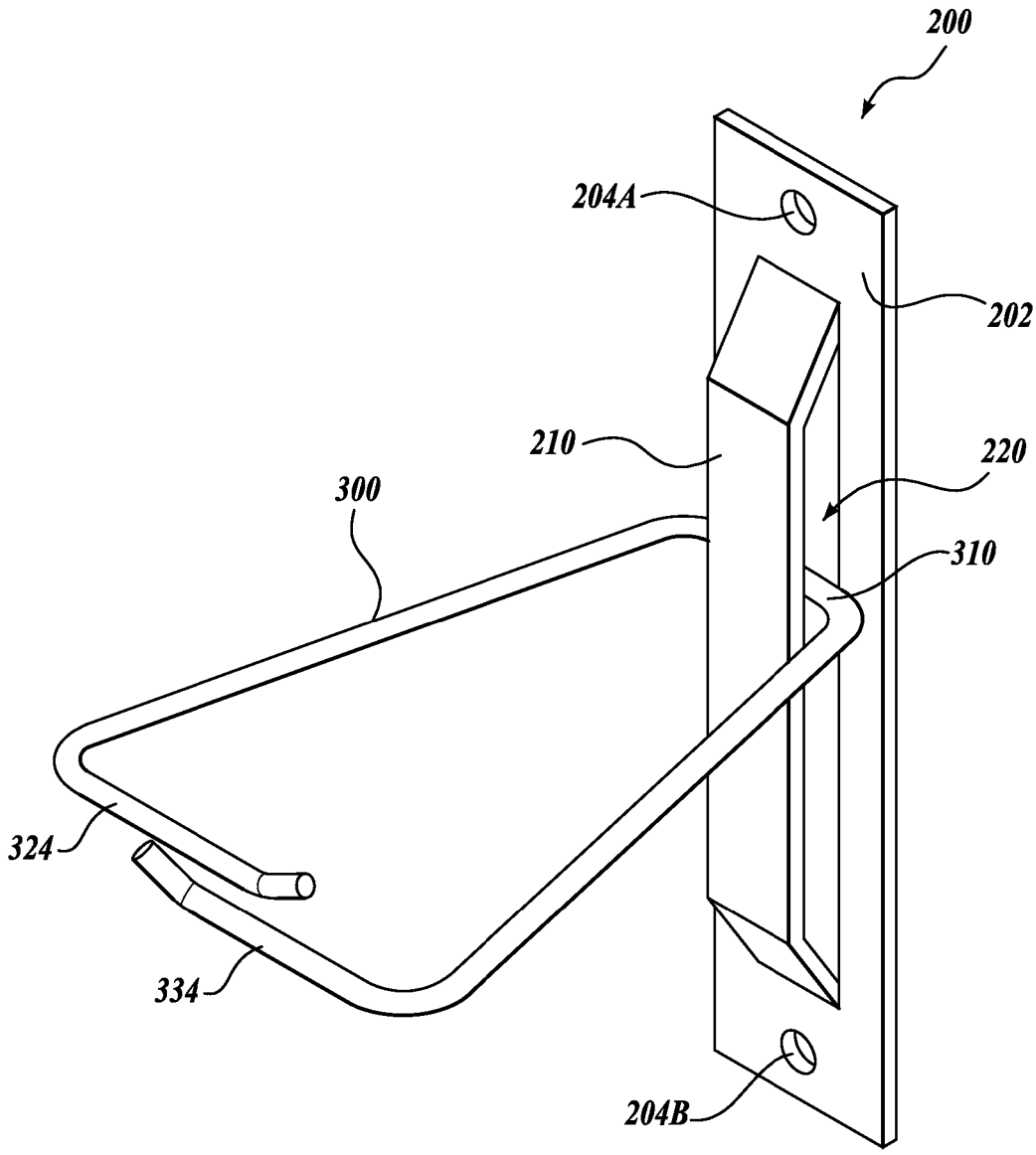
FIG. 2 is a perspective view of an exemplary anchor system of the invention, illustrating an anchor plate vertically positioned with a brick tie interlocked in the anchor plate.

FIG. 2 illustrates an exemplary anchor plate 200 in accordance with one embodiment of the present invention. The exemplary anchor plate 200 comprises a body having a backing member 202 and a projecting member 210 that define a slot 220 therebetween. The projecting member 210 may be formed by punching out a region from the backing member 202 so as to result in a slot 220 that is sufficiently spaced from the backing member 202 to receive and interlock with a portion of the brick tie 300.

Various suitable configurations and dimensions of the anchor plate 300 can be used to accommodate particular applications and/or building code requirements. The elongated rectangular shape of the anchor plate 200 and slot 220 is illustrated in FIG. 2. The anchor plate 200 may be any length suitable for coupling a masonry veneer to a structure. The elongated slot 220 of the anchor plate 200 allows flexibility in positioning a brick tie that interfaces the masonry veneer. In some embodiments, an individual anchor plate 200 receives and interlocks with multiple brick ties to couple multiple sections of masonry veneer to a structure. In other embodiments, an individual anchor plate 200 receives and interfaces with a single brick tie that interfaces the masonry veneer to couple a section of masonry veneer to a structure.

In one exemplary embodiment, the anchor plate backing member 202 is capable of receiving an insertable projecting member 210. For example, the projecting member 210 may be a portion of a larger structure adapted to interface with multiple anchor plate backing members 202. In operation, the projecting member 210 is inserted through an opening in the backing member 202 to form the slot 220 capable of receiving a portion of the brick tie 300.

In another exemplary embodiment, the anchor plate 200 comprises a rectangular backing member 202 body having a slot 220 capable of receiving a portion of the brick tie 300, wherein the slot 220 is integrally formed in the backing member at a location adjacent a first end of the backing member. In such an embodiment, a second end of the rectangular backing member may further comprise a retaining portion capable of securing the anchor plate 200 to a structure.

Typically, masonry veneer is commercially available in standardized panel sizes, such as 16 inch by 24 inch, or 24 inch by 24 inch. Therefore, an exemplary range for a suitable anchor plate is from about 2 inches to about 2 feet. In some embodiments, the length of the anchor plate is greater than 2 feet. In other embodiments, the length of the anchor plate is in the range of about 4 inches to about 12 inches. The width of the backing member 202 can be any width suitable for mounting of the anchor 200 to a structure. See FIG. 1. For example, the width of the backing member 202 can be from about ½ inch to about 2 inches wide. In a preferred embodiment, the anchor plate 200 has the following approximate dimensions: the backing member 202 has an elongated rectangular shape of about 6 inches in length and about 1¼ inches in width. The slot 220 formed between the backing member 202 and the projecting member 210 is approximately 4 inches in length.

In the embodiment of the anchor plate 200 shown in FIG. 2, the backing member 202, the projecting member 210 and the slot 220 are each substantially rectangular in shape, however it should be understood that other suitable shapes may also be utilized. For example, other suitable shapes for the projecting member 210 include a U-shaped member, a V-shaped member, or a rod-shaped member (not shown).

With continued reference to FIG. 2, some embodiments of the anchor plate 200 include a plurality of fastener holes 204A, 204B through the backing member along its length for securing the anchor plate 200 to a structure. The fastener holes 204A, 204B are sized to suit various fasteners, such as screws or bolts, with holes of a diameter such as 5/16 inch to ¼ inch in diameter.

The anchor plate 200 may be constructed out of any suitable non-corrosive material such as galvanized bright steel, hot dipped steel, or stainless steel. In order to maximize the corrosion resistant properties of the anchor 200 as well as minimize cost, it is preferably to manufacture the anchor plates 200 from bright steel followed by hot dip galvanization. For example, the anchor 200 may be constructed of steel in the range of about 11 gauge to about 20 gauge.

Figure 3A:
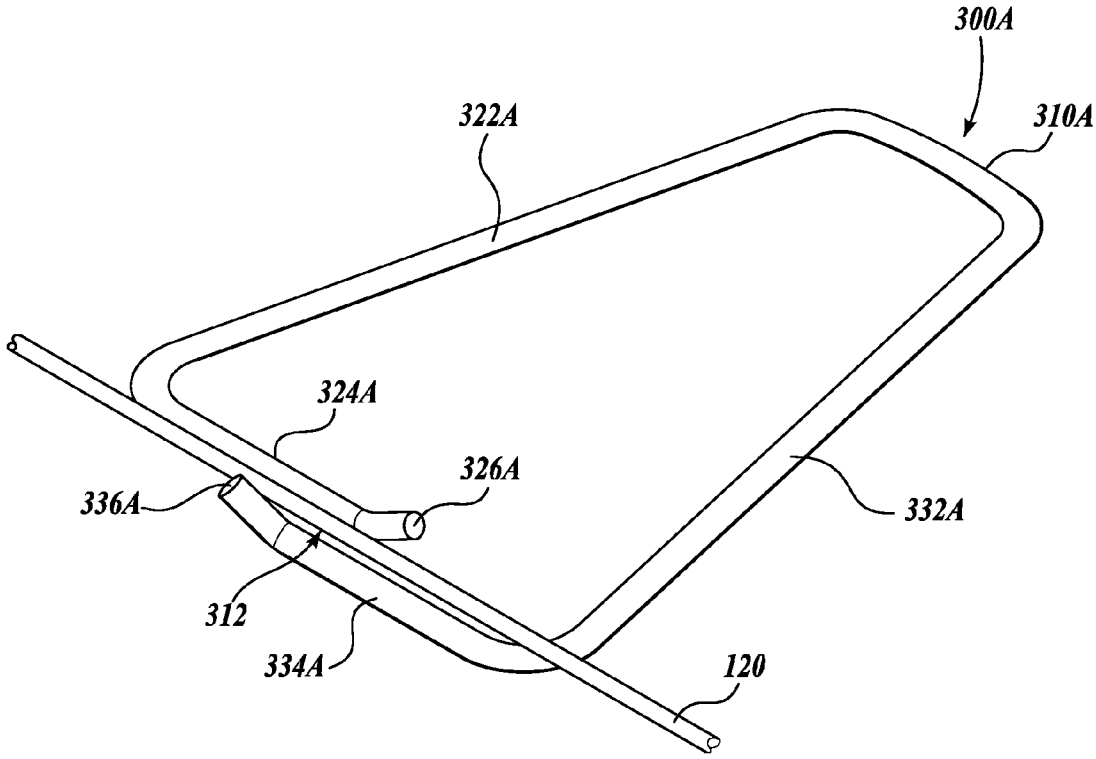
FIG. 3A is a front view of a brick tie comprising a truncated triangular shape with overlapping front legs having distal ends bent in the same direction in accordance with an embodiment of the present invention.

Several configurations for the brick tie 300 are possible. Referring now to FIG. 3A, a front view of a brick tie 300A is shown. The brick tie 300A has a truncated triangular shape with a base portion 310A, a first side leg portion 322A, a second side leg portion 332A, a first front leg portion 324A and a second front leg portion 334A. Included within each of the front leg portions is a region of deflection 326A, 336A. The base portion 310A is shaped and dimensioned to be received and interlock within the slot 220 of the anchor plate 200. The width of the base portion 310A may be any width that is suitable to interlock with the slot 220 anchor of the anchor plate 200. Illustrative examples of suitable widths for the base portion of the brick tie include a range from about ¾ inch to about 6 inches, but preferably from about 1 inch to 2 inches. In the embodiment shown in FIG. 3A, the base portion 310A is substantially straight, however, other suitable shapes may be utilized that correspond to the shape of the anchor plate and allow a secure connection therewith, such as for example, a bowed shape, a rounded shape, or a V-shape.

The first side leg portion 322A and the second side leg portion 332A each extend outwardly and diverge from the base portion 310A at an angle greater than 90 degrees. The length of the side leg portions 322A, 332A may be any length that will allow the brick tie 300A to interlock with the anchor plate 200 and interface with the masonry veneer. Illustrative examples of suitable lengths for the side leg portions include a range from about 2 inches to about 12 inches, more preferably from about 2 inches to about 6 inches. In some embodiments, the first side leg portion 322A and the second side leg portion 332A are different lengths, as described in more detail below.

As shown in the embodiment of the brick tie 300A illustrated in FIG. 3A, the first front leg portion 324A extends inward from the first side leg portion 322A at an angle less than 90 degrees. The second front leg portion 334A extends inward from the second side leg portion 332A at an angle less than 90 degrees and lies parallel to and partially overlaps the first front leg portion 324A. In some embodiments, the front leg portions 324A and 334A are substantially the same length. In other embodiments, the front leg portion 324A is a different length than the front leg portion 334A.

As shown in FIG. 3A, in one embodiment of the brick tie 300A, the second side leg portion 332A is longer than the first side leg portion 322A. The difference in length between the first and second side leg portions is chosen such that a gap 312 is formed between the two substantially parallel, overlapping front leg portions 324A and 334A. The width of the gap 312 is chosen to allow ease of insertion of the second front end portion 334A through the slot 220 of the anchor plate 200. In some embodiments of the system 100, the gap 312 is also sized to accommodate the reinforcement wire 120.

In some embodiments, the brick tie 300A further includes at least one region of deflection on at one or both of the front leg portions. The region of deflection may be located at any position along the front leg portion of the brick tie 300A. The region of deflection provides several unexpected advantages to the brick tie, including an increased ease of insertion into the slot on the anchor plate, increased ease and securement of reinforcement wire, and increased mortar capture. Although not uniformly required, in seismic zones many buildings include a reinforcement wire provision and require the use of mortar capturing features.

With continued reference to FIG. 3A, the first front leg portion 324A includes a first region of deflection 326A located at its distal-most end. A second region of deflection 336A is located at the distal-most end of the second front leg portion 334A. The regions of deflection 326A, 336A may be deflected at any suitable angle that allows for ease of insertion of the brick tie 300A into the anchor plate 200 and/or securement of the anchoring system 100. Illustrative examples of suitable angles of deflection for the deflected region include a range from about 10 degrees to about 350 degrees. In one embodiment, as shown in FIG. 3A, the regions of deflection 326A, 336A are deflected in approximately the same direction, and are deflected in the range of about 30 degrees to about 45 degrees.

Figure 3B:
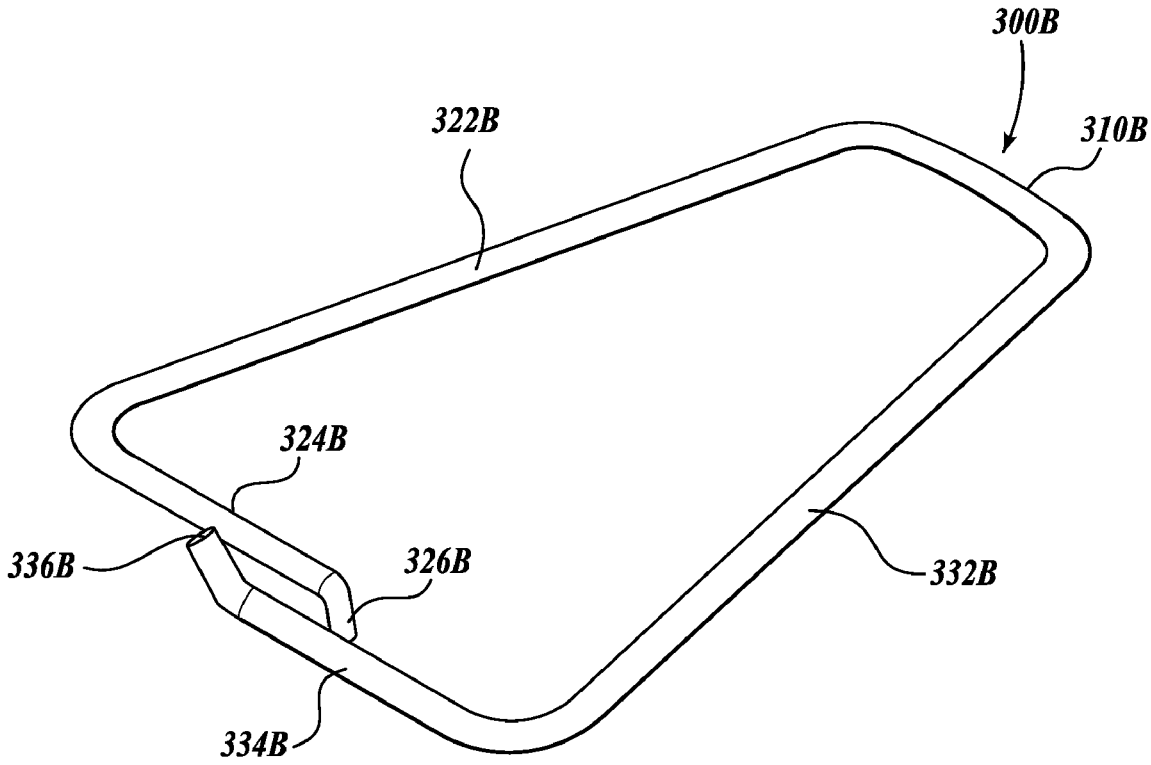
FIG. 3B is a front view of a brick tie comprising a truncated triangular shape with overlapping front legs having distal ends bent in opposite directions in accordance with an embodiment of the present invention.

FIG. 3B illustrates another embodiment of a brick tie 300B. In this embodiment, the first region of deflection 326B is located at the distal-most end of the first front leg 324B and the second region of deflection 336A is located at the distal-most end of the second front leg 334B. The first region of deflection 326B is deflected in a different direction than the second region of deflection 336B.

Figure 3C:
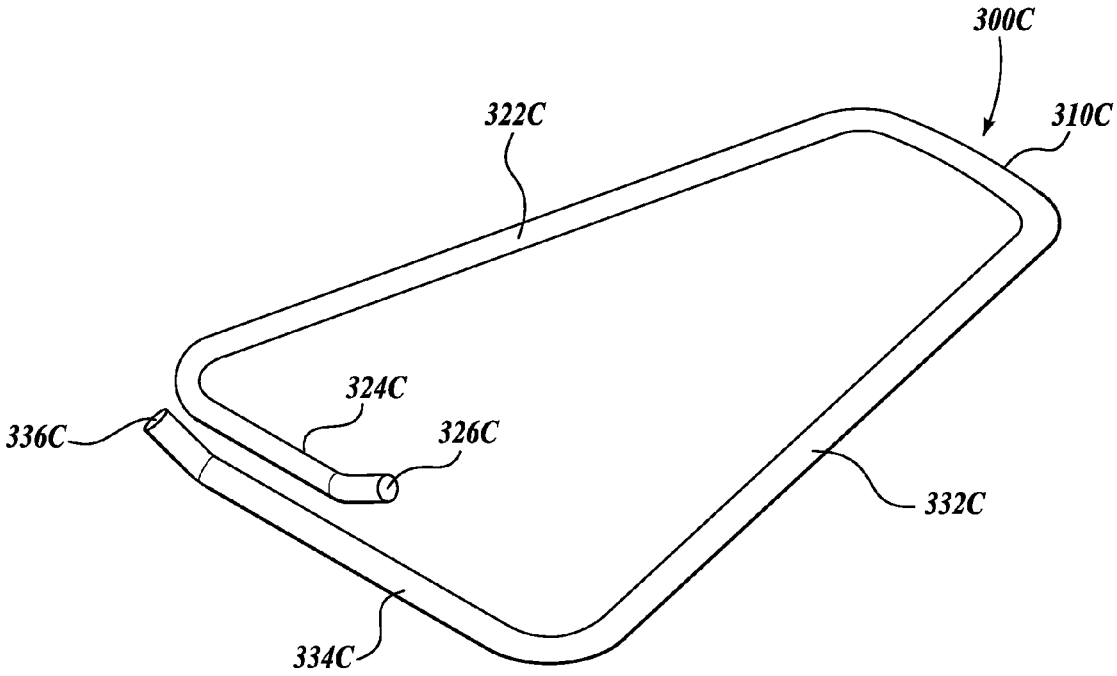
FIG. 3C is a front view of a brick tie comprising a truncated triangular shape with overlapping front legs of different lengths having distal ends bent in the same direction in accordance with an embodiment of the present invention.

FIG. 3C illustrates another embodiment of a brick tie 300C. In this embodiment, the second front leg 334C is longer than the first front leg 324C. The first region of deflection 326C is located at the distal-most end of the first front leg 324C and the second region of deflection 336C is located at the distal-most end of the second front leg 334C. The first region of deflection 326C is deflected in the same direction as the second region of deflection 336C.

Figure 4A:
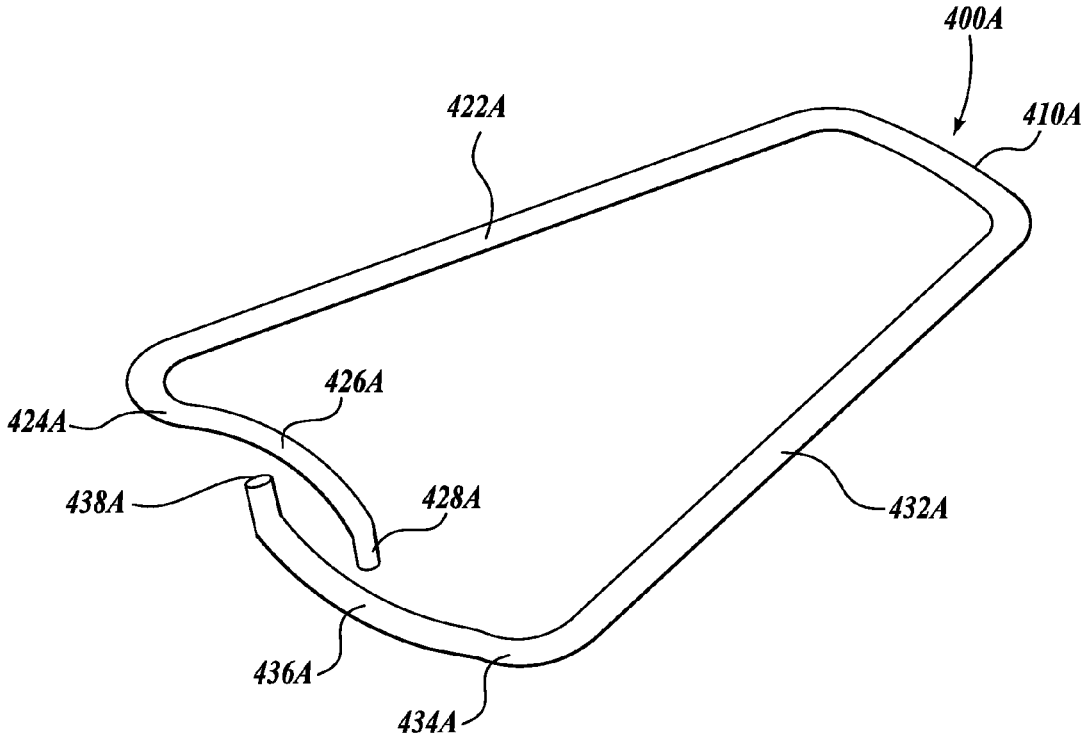
FIG. 4A is a front view of a brick tie comprising a truncated triangular shape with overlapping front legs bowed in opposite directions in accordance with an embodiment of the present invention.

FIG. 4A illustrates another embodiment of a brick tie 400A. In this embodiment, there are two regions of deflection on each front leg portion 424A and 434A. The first region of deflection 426A is an arc that bows in a first direction and is located approximately midway along the first front leg portion 424A. The second region of deflection 428A is located at the distal-most end of the first front leg portion 424A. The third region of deflection 436A is an arc that bows in a second direction different from that of the first region of deflection 426A. The fourth region of deflection 438A is a located at the distal-most end of the second front leg portion 434A.

Figure 4B:
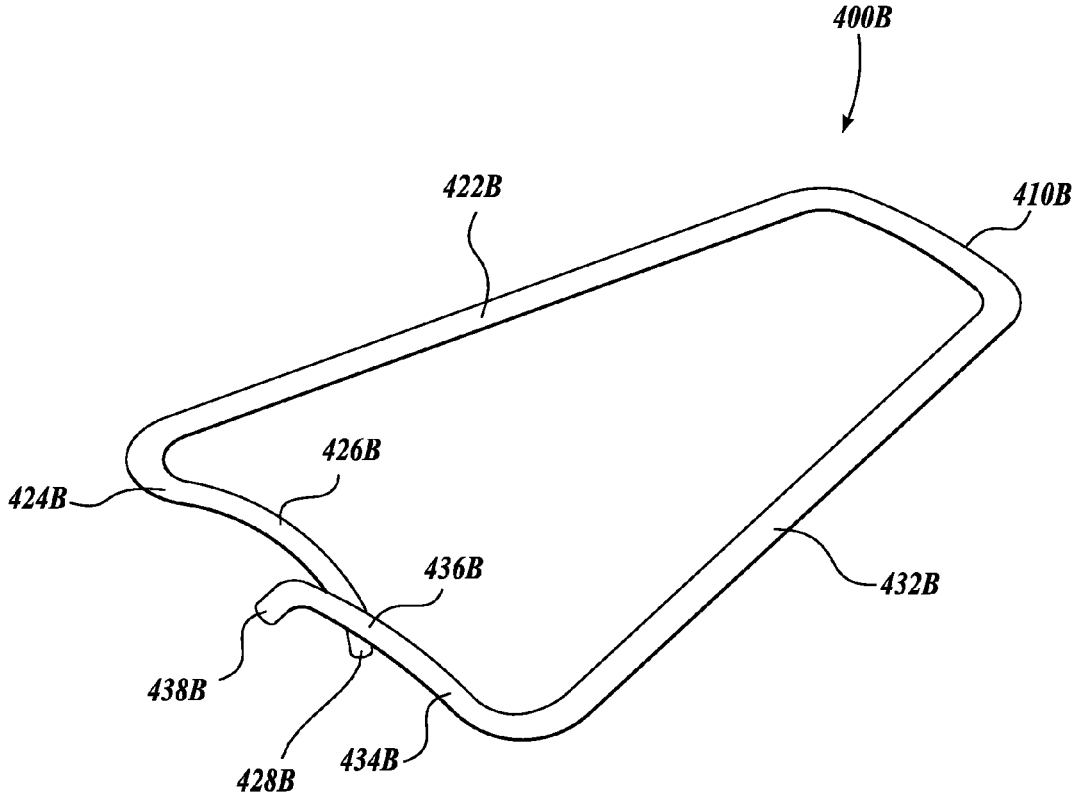
FIG. 4B is a front view of a brick tie comprising a truncated triangular shape with overlapping front legs bowed in the same direction in accordance with an embodiment of the present invention.

FIG. 4B illustrates an embodiment of a brick tie 400B, where the first region of deflection 426B is bowed in the same direction as the third region of deflection 436B.

Figure 4C:
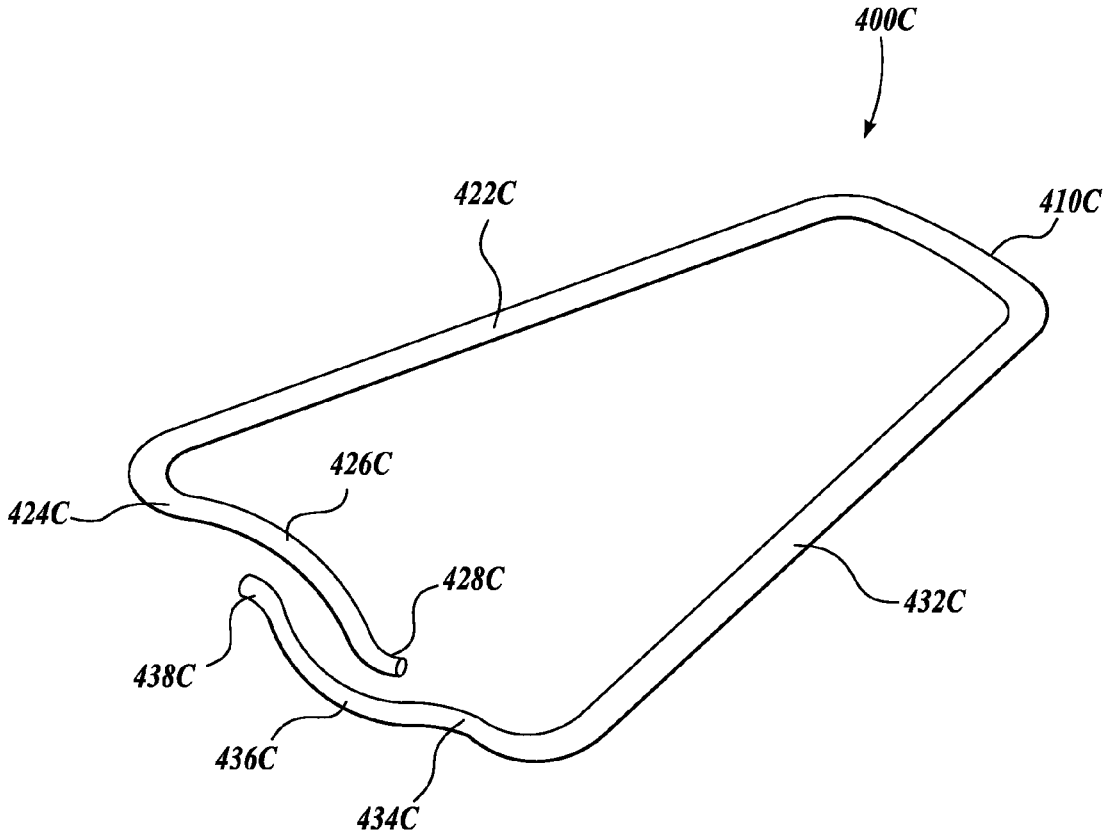
FIG. 4C is a front view of a brick tie comprising a truncated triangular shape with overlapping front legs bowed in the opposite direction and having straight distal ends.

FIG. 4C illustrates an embodiment of a brick tie 400C with two regions of deflection where the first region of deflection 426C extends midway along the first front leg 424C to the distal-most end thereof, and the second region of deflection 436C extends midway along the second front leg 434C to the distal-most end thereof.

The brick tie 300A, 300B, 300C and 400A, 400B, 400C may be constructed from any suitable non-corrosive material, such as, for example, galvanized bright steel or stainless steel wire, either rounded or flat. The wire may be of any suitable gauge, such as, for example wire of 2 gauge to about 10 gauge, such as 2 gauge, 4 gauge, or 6 gauge. In order to enhance the corrosion resistant properties of the brick tie as well as to minimize cost, it is preferable to manufacture it from bright steel followed by hot dip galvanization.

In operation of the anchoring system 100, at least one anchor plate 200 is mounted to the structure 112 by inserting fasteners such as screws into the fastener holes as illustrated in FIG. 1. Each anchor plate 200 is mounted to the structure 112 using any suitable fastener. A plurality of anchor plates 200 may be used in the system 100, wherein each anchor plate 200 is mounted at any suitable distance from the other anchors 200 to securely couple masonry veneer to the structure. The anchor plates 200 may be mounted to the structure 112 in any orientation suitable to couple masonry veneer to the structure. For example, the anchors 200 may be mounted to the structure 112 in a vertical or horizontal position, or the anchors 200 may be mounted to the structure 112 at any angle between zero degrees and ninety degrees. The structure 112 may be an interior or exterior wall, such as, for example, a stud supported backup wall such as a drywall, a steel stud supported wall, a concrete block wall, a poured concrete wall, or a steel I-beam wall.

Referring again to FIG. 1, after at least one anchor plate 200 is mounted to the structure 112, at least one brick tie 300 is positioned in a bed joint 116 to interface with a section of masonry veneer 114 and interlock with the mounted anchor plate 200. Referring now to FIG. 2, the mason clips the brick tie 300 into the anchor plate 200 by inserting the second front leg portion 334 of the brick tie 300 through the slot 220 on the anchor plate 200. The mason then moves the brick tie 300 into position so that the base portion 310 interlocks with the projecting member 210 on the anchor plate 200. As shown in FIG. 1, once the base portion 310 of the brick tie 300 is interlocked with the anchor plate 200, the brick tie 300 is placed horizontally on a vertically positioned section of veneer 114 and the front leg portions of the brick tie 324, 334 are placed in the bed joint 116 of the veneer 114 and embedded in mortar. The elongated shape of the anchor plate 200 and slot 220 allows for flexible positioning of the brick tie 300 during installation of the masonry veneer 114. In some embodiments of the system 100, as shown in FIGS. 1 and 3A, reinforcing wire 120 runs through the overlapping arms and deflected regions 326A, 336A on the brick tie 300 to increase mortar capture for additional strength in the system 100. The brick tie 300 is capable of vertical movement within the slot 220 to enable adjustable positioning of the brick tie to interface the mortar joint 116.

Figure 5:
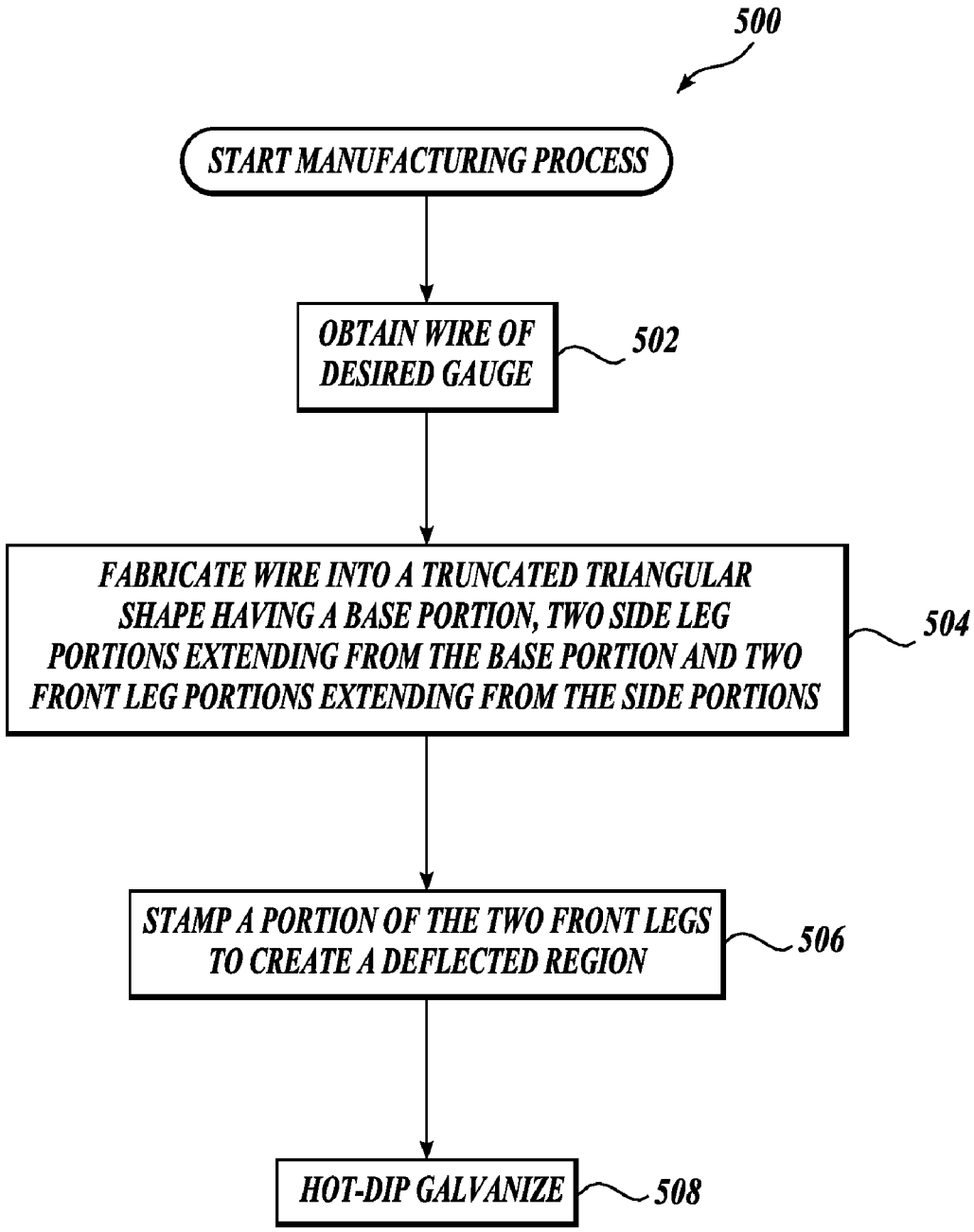
FIG. 5 is a process diagram of a method for manufacturing a brick tie for a masonry coupling system in accordance with one embodiment of the present invention.

In yet another aspect, the present invention includes a method for manufacturing a brick tie. FIG. 5 shows a process diagram of a method 500 for manufacturing a brick tie for a masonry anchoring system in accordance with one embodiment of this aspect of the invention. From a start block, the method 500 proceeds to block 502 where the method 500 obtains a steel wire of appropriate gauge and dimension. At block 504 the method 500 fabricates the wire into a truncated triangular shape by bending the wire to include a base portion and a first side leg portion and a second side leg portion extending from the base portion at divergent angles. The first side leg portion is then bent to form a first front leg portion. The second side leg portion is then bent to form a second front leg portion that is parallel to and partially overlaps the first front leg portion. The method 500 then stamps a portion of each of the front leg portions to form a region of deflection. Proceeding to block 508, the method 500 dips the brick tie into a molten substance to form an alloy coating to provide cathodic protection. The molten substance that provides cathodic protection may be any suitable substance such as a substance selected from Group 2B elements. Examples of suitable substances include zinc and cadmium.

While the preferred embodiment of the invention has been illustrated and described, it will be appreciated that various changes can be made therein without departing from the spirit and scope of the invention.

The invention claimed is:

1. In a system for coupling a masonry veneer to a structure, a brick tie that interfaces the masonry veneer and interlocks with an anchor mounted on the structure, comprising:

a substantially triangular shaped and substantially horizontal planar body including a base portion capable of interlocking with the anchor;

a first side leg portion, and a second side leg portion, wherein each side leg portion extends from the base portion at diverging obtuse angles; and a first front leg portion and a second front leg portion, wherein the first and second front leg portions each extend from the first and second side leg portions at converging acute angles; and wherein the first front leg portion comprises a first deflected distal end portion and the second front leg portion comprises a second deflected distal end portion, wherein the first and second deflected distal end portions are each deflected away from the horizontal plane of the substantially triangular shaped body at an angle in the range of about 30 degrees to about 45 degrees.

2. The brick tie of claim 1, wherein the first front leg portion and the second front leg portion are substantially parallel to one another and partially overlap one another.

3. The brick tie of claim 2, wherein the first front leg portion and the second front leg portion are spaced apart from one another by a distance sufficient to allow the second leg portion to be inserted into a slot defined by a projecting member of the anchor plate.

4. The brick tie of claim 2, wherein the first front leg portion and the second front leg portion are substantially the same length.

5. The brick tie of claim 2, wherein the first front leg portion and the second front leg portion are different lengths.

6. The brick tie of claim 1, wherein the deflected distal end portion and the second deflected distal end portion are deflected in the same direction.

7. The brick tie of claim 1, wherein the deflected distal end portion and the second deflected distal end portion are deflected in different directions.

8. The brick tie of claim 1, wherein the brick tie comprises steel wire in a gauge of from about 11 to about 20.

9. The brick tie of claim 1, wherein the base portion is at least about 1 inch in length.

10. A masonry coupling system, comprising:

at least one anchor plate mounted on a structure for anchoring a masonry veneer to the structure, each anchor plate including a backing member comprising means for securing the anchor plate to the structure and a projecting member defining a slot for receiving a brick tie therethrough; and at least one brick tie, each brick tie interfacing with the masonry veneer and interlocking with at least one anchor plate mounted on the structure, each brick tie comprising a substantially triangular and substantially horizontal planar body including a base portion capable of interlocking with the anchor;

a first side leg portion and a second side leg portion, wherein each side leg portion extends from the base portion at diverging obtuse angles; and a first front leg portion and a second front leg portion, wherein the first and second front leg portions each extend from the first and second side leg portions at converging acute angles;

wherein the first front leg portion comprises a first deflected distal end portion and the second front leg portion comprises a second deflected distal end portion, wherein the first and second deflected distal end portions are each deflected away from the horizontal plane of the substantially triangular shaped body at an angle in the range of from about 30 degrees to about 45 degrees.

* * * * *